US006786986B2

(12) United States Patent
Filho

(10) Patent No.: US 6,786,986 B2
(45) Date of Patent: Sep. 7, 2004

(54) NON-TOXIC COMPOSITION FOR PRIMING MIXTURE FOR SMALL CALIBER ARMS AMMUNITION

(75) Inventor: Laudemiro Martini Filho, Guapitiba (BR)

(73) Assignee: Companhia Brasileira de Cartuchos (BR)

( * ) Notice: Subject to any disclaimer, the term of this patent is extended or adjusted under 35 U.S.C. 154(b) by 0 days.

(21) Appl. No.: 10/413,273

(22) Filed: Apr. 14, 2003

(65) Prior Publication Data

US 2004/0016483 A1 Jan. 29, 2004

(30) Foreign Application Priority Data

Jul. 18, 2002 (BR) ..... 0202906

(51) Int. Cl.[7] ..... C06B 45/06; C06B 31/24; C06B 25/18; C06B 35/08; D03D 23/00

(52) U.S. Cl. ..... 149/18; 149/38; 149/64; 149/96; 149/100; 149/108.6

(58) Field of Search ..... 149/38, 64, 96, 149/108.6, 18, 100, 99, 37, 43, 44, 61, 62, 63

(56) References Cited

U.S. PATENT DOCUMENTS 3,854,400 A * 12/1974 Van Langenhoven ..... 102/38
4,608,102 A * 8/1986 Krampen et al. ..... 149/92
5,610,367 A * 3/1997 Erickson et al. ..... 149/35
6,478,903 B1 * 11/2002 John, Jr. et al. ..... 149/18

* cited by examiner

*Primary Examiner*—Aileen B. Felton
(74) *Attorney, Agent, or Firm*—Akerman Senterfitt

(57) ABSTRACT

This disclosure considers the use of specifically-sized Nitrocellulose particles of 75 ml fineness, free of other chemicals, as a flame enhancer in a Diazodinitrophenol primer mixture that is free of heavy metal constituents.

9 Claims, No Drawings

NON-TOXIC COMPOSITION FOR PRIMING MIXTURE FOR SMALL CALIBER ARMS AMMUNITION

BACKGROUND ART

Since the 1930's, the primers for small arms ammunition have, generally, contained Lead Styphnate as a primary explosive, Tetracene to sensitize the Lead Styphnate, Barium Nitrate for an oxidizer, Antimony Sulfide for a frictionator and fuel, a secondary explosive like PETN for brisance, and various gums as a binder. These primers were very successful for many years and are still in use today. They are very reliable, moisture resistant, and stable in storage and use. They were a great improvement over the corrosive Potassium Chlorate and Mercury Fulminate primer mix formulations in use prior to that time.

Now, however, there has been a growing demand for a primer that is non-toxic to the shooter and the environment, when fired in indoor ranges. Heavy metal byproducts of primer combustion, such as Lead, Barium, and Antinomy can be harmful when inhaled or ingested by the shooter. Many indoor shooting ranges have been closed in recent years because of these hazards. Consequently, customers are demanding primers that are free of Lead, Barium, and Antimony compounds.

Many patents have been issued over the last few years for priming compositions that are free of these heavy metals. They usually contain Potassium Dinitrobenzofuroxan (KDNBF) or Diazodinitrophenol (DDNP) as a primary explosive, Tetracene as a sensitizer, powdered Aluminum for a fuel, Calcium Silicide, powdered glass, or Boron as a frictionator, and various gums for a binder. The oxidizers used are $KNO_3$, $SnO_2$, $CaCO_3$, $MnO_2$, $Sr(NO_3)_2$, etc. Processed propellant material, such as WC 669, and ground double base propellants have been used as a flame enhancers in these priming mixes. These nitrocellulose-based products work as intended, but are not ideal because they are usually granular materials of random size or propellant by-products with graphite, flash suppressants, and other chemicals, which are not desirable in primers.

Another drawback of the Nitrocellulose and processed propellant flame enhancers used previously is that they can result in Nitrocellulose agglomerations or propellant particles of a size that can cause misfires in the ammunition. Further, the Nitrocellulose agglomerations are not easily dispersed and do not blend uniformly throughout the primer mixture. It is known that such masses of these materials have been deposited between the anvil tip and primer cup in Centerfire percussion primers that created a "dead spot" which caused the primer to fail to fire on impact of the firing pin. Similar "dead spots" have also been found in Rimfire ammunition when such particles or agglomerations were found to be deposited in the annulus of the cartridge rim.

DESCRIPTION OF THE INVENTION

The research that led to the present invention revealed that by using a Nitrocellulose of very small fibers, with dimensions of 75 ml fineness or less, allow the production of an improved non-toxic priming composition that is more uniform and at a more cost-effective price as compared to the state of the art.

The improvement corresponds to the dimensioning of the nitrocellulose fibers used in the priming composition. The limitation of fiber dimension to 75 ml or less ensures easy dispersion of the Nitrocellulose, fostering its complete mixing with the remaining chemicals used in the priming mixture and thus practically eliminating the risk of forming clusters and warranting uniform, homogenous mixtures. It is worth remembering that the mixture uniformity is a commanding feature for the primer detonator sensitivity with major influence over the ballistic performance.

One added advantage of the present invention is that the mixture homogeneity makes its dosing easy whatever the scale used, thus ensuring the production of uniform pellets which are homogenous as far as their composition is concerned, therefore featuring also homogenous and uniform weights.

The elimination of the risk of clustering of the flame enhancer Nitrocellulose during the manufacture of the primer mixture prevents the appearance of the so-called "dead spots" both in Centerfire and Rimfire primer detonators that can cause misfires in small arms cartridges. Furthermore it eliminates the risk of other similar dead spots due to lack of homogeneity that could occur in the mixture when processed propellants are used as flame enhancers.

Chemically, the specific sized small particle Nitrocellulose is a pure material, which does not have any nitroglycerin, Diphenylamine, graphite, flash suppressants, or residual alcohol-acetone, which would get into the primer. These adulterating chemicals can destabilize the non-toxic priming and generate adverse ignition temperatures, especially under extreme ambient temperature conditions.

Another advantage of the present invention is the reduction of the effective production cost. Said reduction derives from the fact that the processed propellants used in the primer mixture composition are obtained from nitrocellulose, which before reaching the processed propellant condition undergoes the following processing steps: dilution in alchool-ketone, maceration, extrusion, cut, drying, annealing, mixing, etc. In the present invention, the nitrocellulose is added in natura to the primer mixture composition, therefore foregoing all the processing steps previously required to reach the condition of processed propellant. The addressed economy gain derives from the elimination of the use of the raw materials required for the steps of dilution in alchool-ketone, maceration, mixing, etc., and also the dropping of the previously required skilled workforce for performing such steps.

Among the various formulations of non-toxic primer mixtures composition using specifically-sized Nitrocellulose tested, it was found that the formula presented on Table 1 below featured better results with the lowest effective cost.

TABLE 1

PROCESSING EXEMPLE

| | Preferred Percentage | Acceptable Extended Range |
|---|---|---|
| Diazodinitrophenol | 35 | 30–45 |
| Tetracene | 5 | 4–6 |
| Specific-sized Nitrocellulose | 25 | 12–30 |
| Potassium Nitrate | 17 | 10–19 |
| Powdered aluminum | 4 | 4–7 |
| Powdered glass | 13 | 8–15 |
| Gum Tragacanth | 1 | 0.1–1 |

Diazodinitrophenol manufactured by the standard procedure of reacting Hydrochloric acid and Sodium Nitrite with Sodium Picramate is washed and de-watered. A moisture check is made and it is put in storage until used.

Tetracene and specifically-sized Nitrocellulose are also tested for moisture and stored until needed.

Potassium Nitrate, Powdered Aluminum, ground glass, and gum Tragacanth are weighed out in the correct proportions and are blended. This dry pre-mix is then stored until needed in the final composition mixing.

The wet Diazodinitrophenol, Nitrocellulose, and Tetracene are weighed in the correct proportions, according to their moisture content, in preparation for the mixing process. The total amount of moisture in these components is calculated, and if additional water is required to make a final primer mix of the correct water content, it is measured out before the mixing process begins.

In the final mixing process, the three wet components, Diazodinitrophenol, Specifically-sized Nitrocellulose, Tetracene and additional water are placed in the mixing bowl. These are then blended thoroughly by remote control until thoroughly homogenized. The dry mix is then added to the mixing bowl and blended remotely until the final primer mix is completely homogenous. The blended primer mix is then removed from the mixer bowl, transferred to conductive containers, and stored until used. Charging of the mix and assembly of primers is done in the usual manner, and is well known to those experienced in the art.

PRIMER TEST DATA

CBC No. 1½ small pistol size primers were made using a primer mix formulation in the preferred percentage proportions and tested in 9 mm Luger cases and ammunition. These were tested in comparison with the CBC No. 1½ small pistol primer and compared to SAAMI specifications. These were found to comparable in all respects. The results of these tests are presented in Tables 2 and 3 below.

TABLE 2

| Primer detonator sensitivity test results | Non-toxic mixture primer detonator Samples | Primer detonators with Lead Styphnate based mixture | SAAMI Directive |
|---|---|---|---|
| H – Mean Height of fire | 11.83 cm | 13.64 cm | 11.0 cm |
| s – standard deviation | 2.05 cm | 1.36 cm | 4.25 cm |
| H – 2s – non-operating height | 7.73 cm | 10.92 cm | 2.5 cm |
| H + 4s – Operating height | 20.03 cm | 19.08 cm | 28.0 cm |

TABLE 3

| Ballistic test results | Cartridges with detonators loaded with non-toxic primer mixture N.° 1 ½ NT | Cartridges with detonators loaded with Lead Styphnate based primer mixture N.° 1 ½ | SAAMI Directive |
|---|---|---|---|
| Chamber pressure (+ 21° C.) | 2099 kgf/cm$^2$ | 2099 kgf/cm$^2$ | 2510 kgf/cm$^2$ |
| s (Standard deviation) | 73 kgf/cm$^2$ | 75 kgf/cm$^2$ | Not available |
| Chamber pressure (+ 50° C.) | 2128 kgf/cm$^2$ | 2124 kgf/cm$^2$ | Not available |
| s (Standard deviation) | 80 kgf/cm$^2$ | 83 kgf/cm$^2$ | Not available |

TABLE 3-continued

| Ballistic test results | Cartridges with detonators loaded with non-toxic primer mixture N.° 1 ½ NT | Cartridges with detonators loaded with Lead Styphnate based primer mixture N.° 1 ½ | SAAMI Directive |
|---|---|---|---|
| Chamber pressure(– 50° C.) | 2015 kgf/cm$^2$ | 1969 kgf/cm$^2$ | Not available |
| s (Standard deviation) | 130 kgf/cm$^2$ | 83 kgf/cm$^2$ | Not available |
| Velocity (+ 21° C.) | 330 m/s | 327 m/s | 332 ± 27 m/s |
| s (Standard deviation) | 5 m/s | 5 m/s | Not available |
| Velocity (+ 50° C.) | 334 m/s | 332 m/s | Not available |
| s (Standard deviation) | 5 m/s | 7 m/s | Not available |
| Velocity (– 50° C.) | 319 m/s | 312 m/s | Not available |
| S (Standard deviation) | 9 m/s | 7 m/s | Not available |

Those skilled in the art will realize that the foregoing description of one of the preferred embodiments does not limit the application of the present invention to mixture compositions with the characteristics described, and that it can be applied to other similar compositions for priming mixtures without departing from the scope and inventive spirit covered on the following set of claims.

What is claimed is:

1. A non-toxic composition for small caliber arms ammunition, which is free of heavy metals, comprising nitrocellulose fibers having a fineness of 75 ml or less with a priming mixture, and which is free of contaminating chemicals selected from the group consisting of graphite and diphenylamine.

2. The non-toxic composition according to claim 1, wherein the nitrocellulose is pure and free of any residual acetone or alcohol.

3. The non-toxic composition according to claim 1, comprising diazodinitrophenol in a percentage weight of 30% to 45%.

4. The non-toxic composition according to claim 1, comprising Tetracene in a percentage weight of 4% to 6%.

5. The non-toxic composition according to claim 1, comprising nitrocellulose in a percentage weight of 12% to 30%.

6. The non-toxic composition according to claim 1, comprising potassium nitrate in a percentage weight of 10% to 19%.

7. The non-toxic composition according to claim 1, comprising powdered aluminum in a percentage weight of 4% to 7%.

8. The non-toxic composition according to claim 1, comprising powdered glass in a percentage weight of 8% to 15%.

9. The non-toxic composition according to claim 1, comprising gum Tragacanth in a percentage weight of 0.1% to 1%.

* * * * *